US007004073B2

(12) United States Patent
Michel

(10) Patent No.: US 7,004,073 B2
(45) Date of Patent: Feb. 28, 2006

(54) SYSTEM FOR DISPENSING PROJECTILES AND SUBMUNITIONS

(75) Inventor: Matthew Alan Michel, Bristow, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/671,066

(22) Filed: Sep. 26, 2003

(65) Prior Publication Data

US 2005/0066840 A1 Mar. 31, 2005

(51) Int. Cl.
*F42B 12/60* (2006.01)
*F42B 12/62* (2006.01)

(52) U.S. Cl. ..... 102/393

(58) Field of Classification Search ..... 102/393; 92/12.1, 34, 35, 37, 39, 45, 46
See application file for complete search history.

(56) References Cited

U.S. PATENT DOCUMENTS

| | | | | |
|---|---|---|---|---|
| 2,625,880 | A * | 1/1953 | Brown | 102/393 |
| 3,119,302 | A * | 1/1964 | Barr | 89/1.14 |
| 3,646,889 | A * | 3/1972 | Davis | 102/229 |
| 3,771,455 | A | 11/1973 | Haas | |
| 3,797,359 | A | 3/1974 | Mawhinney et al. | |
| 3,881,416 | A | 5/1975 | Dilworth, Jr. | |
| 4,714,020 | A * | 12/1987 | Hertsgaard et al. | 102/351 |
| 5,005,481 | A * | 4/1991 | Schneider et al. | 102/393 |
| 5,094,170 | A * | 3/1992 | Raynaud et al. | 102/489 |
| 5,253,587 | A * | 10/1993 | Thouron et al. | 102/351 |
| 5,372,071 | A * | 12/1994 | Richards et al. | 102/378 |
| 6,540,175 | B1 | 4/2003 | Mayersak et al. | |
| 2002/0083822 | A1 | 7/2002 | Ross et al. | |
| 2003/0019386 | A1 | 1/2003 | Lloyd et al. | |

* cited by examiner

*Primary Examiner*—Teri Pham Luu
*Assistant Examiner*—Bret Hayes
(74) *Attorney, Agent, or Firm*—Buchanan Ingersoll PC

(57) ABSTRACT

A bellows, spool, and collar system for dispensing projectiles and submunitions with a predictable and uniform pattern is disclosed. The system utilizes projectiles densely packed in a spool. A plurality of spools is packaged in a missile, bomb, or similar tubular device with an energetic bellows actuator between each spool. The energetic bellows actuator expands rapidly to push a spool of projectiles out of the tubular housing. Timing means is provided for each bellows to provide proper axial spacing between spools prior to subsequently timed release of the projectiles.

28 Claims, 23 Drawing Sheets

- GENERAL TRENDS
  - FOR SEPARATIONS WHERE x/d < 2.2 THE DRAG ON DISK 2 IS ACTUALLY NEGATIVE
  - DRAG ON DISK 2 ASYMPTOTICALLY APPROACHES ITS FREE AIR DRAG AT x/d = 7

| GAP, x (in) | DART 1 DRAG ($lb_f$) | DART 2 DRAG ($lb_f$) | DART 3 DRAG ($lb_f$) | DART 4 DRAG ($lb_f$) | DART 5 DRAG ($lb_f$) |
|---|---|---|---|---|---|
| | | | | | |
| 0.25 | 2.1 | 1.25 | 1.1 | 0.9 | 0.8 |
| 1.00 | 2.1 | 1.4 | 1.2 | 1.1 | 0.9 |
| 2.00 | 2.1 | 1.5 | 1.3 | 1.2 | 1.1 |

v = 1500 ft/sec, m = 35 g

SYSTEM FOR DISPENSING PROJECTILES AND SUBMUNITIONS

SPECIAL NOTE

Some of the testing and results presented in this application were partially funded by the United States Government, who may have rights to certain data.

BACKGROUND OF THE INVENTION

This invention relates to weapons designed to dispense a plurality of projectiles. The system particularly pertains to dispensers that attempt to achieve a predictable pattern in both size and uniformity at a target location.

Weapons incorporating projectile dispensers have existed for decades. In general, the goal of these dispensers has been to release a plurality of projectiles such that they strike a target a short period of time later at some increased pattern size than their original packing in the weapon. However, there have been a number of problems associated with these weapons.

The first problem is packing density. The density of the projectile packing in the weapon was often very inefficient because the projectiles often had fins to aid in keeping the projectile stable from time of release to impact with the target. True tangential packing of cylindrical shaped projectiles yields maximum density, but dispensers of the past have not achieved this.

The second problem is collisions between projectiles and other projectiles or collisions between projectiles and the dispenser. Flechette dispensers of the past often had to pack nose to tail in order to increase packing density. With half of the projectiles needing to flip 180 degrees and damp out, many collisions occurred as well as problems with projectiles never damping out before striking the target. Packing density also pushed many dispensers to put rows of projectiles right behind one another. Aerodynamic drafting caused aft rows to catch up to and collide with rows in front of them.

The third problem is unreliable angles of attack upon release. Most spinning dispensers utilized sabots or other means to release projectiles as they emerged from the tube. There is little control over each individual projectile's angle of attack at release in these designs. Also, multi-row dispensers generally were ejected and released by one or two events with no control over each individual row's ejections or each row's release timing.

The fourth problem was the predictability and uniformity of the pattern of projectiles at the target. Often times in prior art dispensers the actual pattern diameter, length and width, or other pattern size was not predictable. Furthermore, the actual uniformity of the individual projectiles within the pattern was not well known in advance. Voids in the pattern, stray projectiles, and bunching in the patterns were common. These problems arose from a number of causes. First, the dispense start event and duration was generally not programmable or flexible enough to allow a pattern of a specific size to be generated at the target. Second, the packaging of the darts was in a random state within the tube before dispense, so the pattern was random after being expanded to the target. Third, the collisions and angle of attack disturbances at release caused the projectiles to fly to an unpredictable location on the target. Lastly, multi-row dispensers were generally forced to release all at once or aft to forward. Both cases result in the forwardmost row having the least amount of time to expand before striking the target. In the same group, the aft row released first or simultaneously with the front row had more time to expand before hitting the same target. This caused the pattern to be dense in the center and more and more sparse at the periphery of the pattern.

SUMMARY OF THE INVENTION

The system described in this disclosure addresses each of these problem areas in the prior art. The invention solves or greatly improves each of the important aspects in creating a system that dispenses projectiles or submunitions in a predictable and uniform pattern using novel components which may be programmed prior to launch. Because the bellows actuators can be custom timed and the spools can be connected or unconnected via the bellows depending on the desired effect, the system provides a simple yet extremely flexible means of ejecting multiple rows (spools) of projectiles. Once all spools of projectiles have been fully ejected from the tube, a small capacitively powered firing module riding in a system of collars surrounded by a wire rope or similar cord explosively cuts the cord and allows each spinning spool to dispense the projectiles radially outward. The timing of each spool cord cut event can be customized to provide additional flexibility in the system. The system uses its unique ability to custom sequence the ejections and release events to produce a predictable and uniform pattern of projectiles at the target.

DETAILED DESCRIPTION OF THE PREFERRED EMBODIMENT

Figure 1:
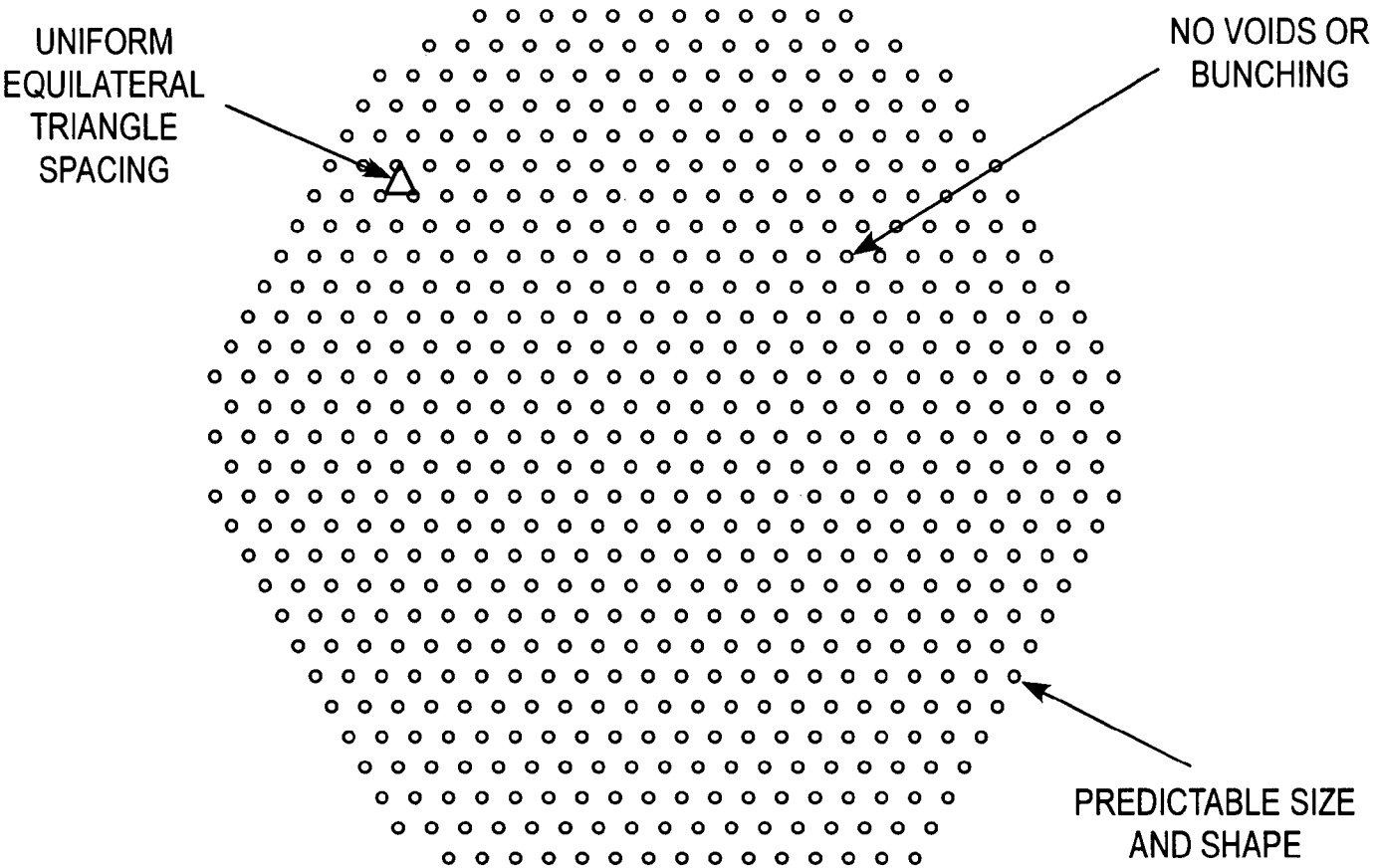
FIG. 1 illustrates the goal of a predictable and uniform dispenser, a pattern of known size and shape with projectiles spaced without voids or bunching.
Figure 2:
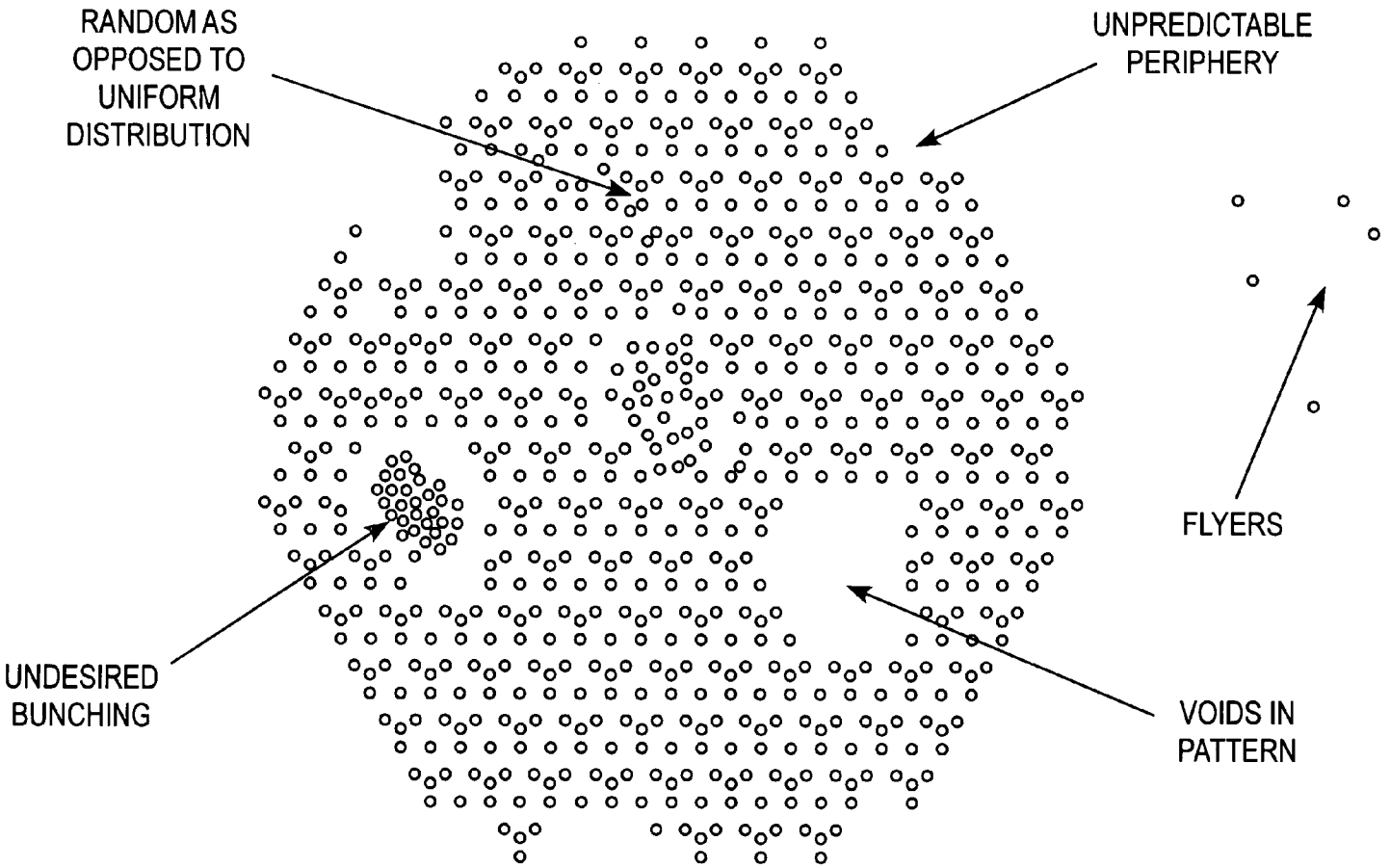
PRIOR ART FIG. 2
FIG. 2 illustrates the problems with typical prior art dispensers including flyers, unpredictable periphery, bunching, voids, and randomness.
Figure 3:
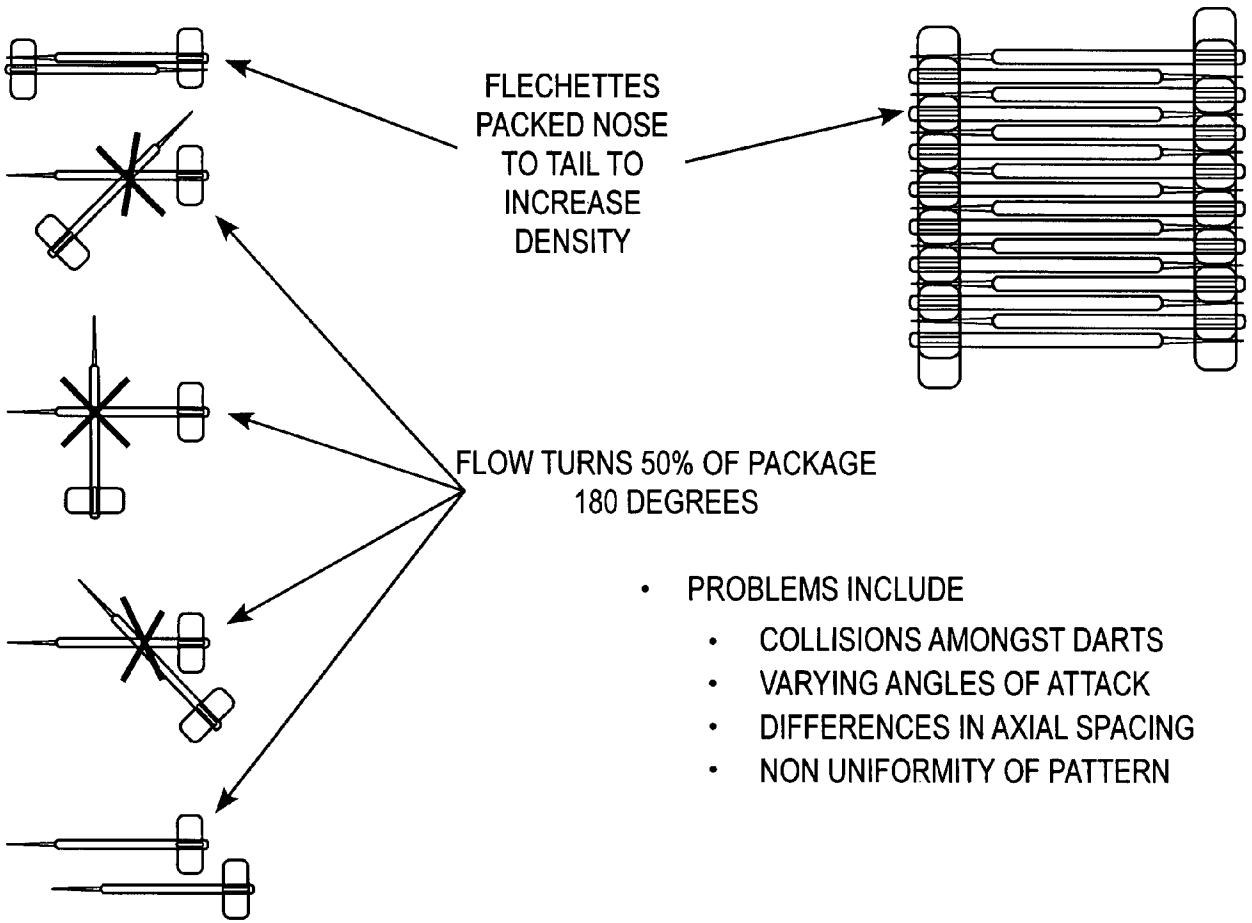
FIG. 3 illustrates the typical prior art nose to tail packing of flechettes and the problems that occur due to this packing type.
Figure 4:
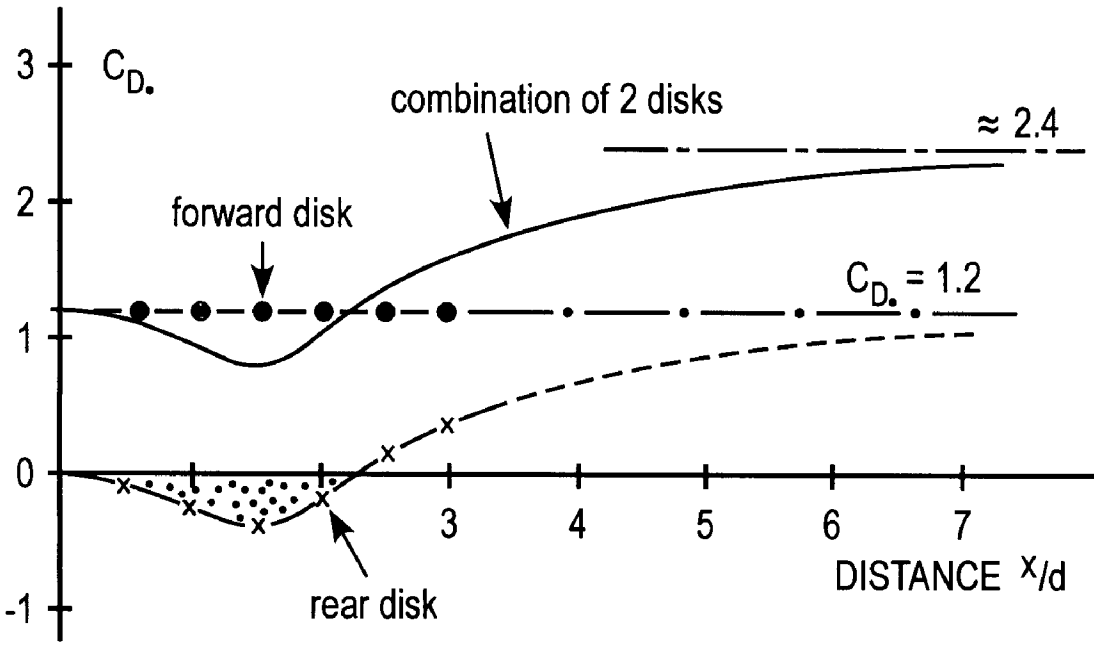
PRIOR ART FIG. 4
FIG. 4 illustrates the typical relationship between two objects following closely as their separation distance increases.
Figure 5:
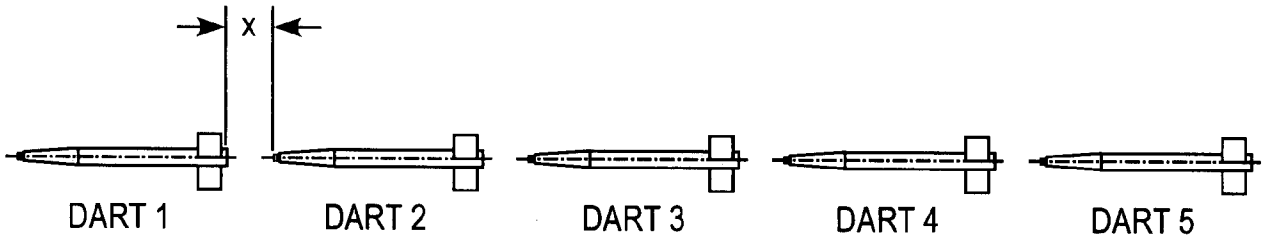
FIG. 5 illustrates the results of aero modeling five specific dart-like projectiles following one another with axes in line.
Figure 6:
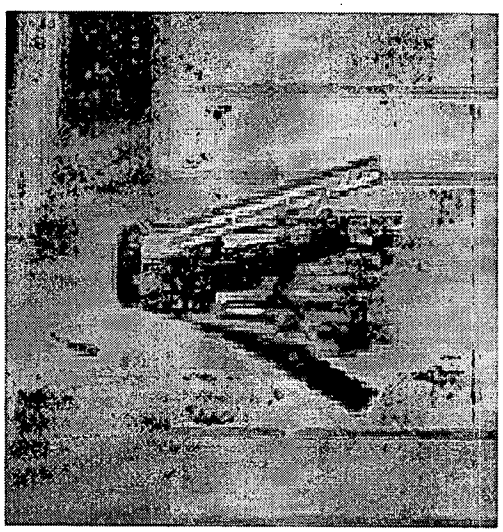
FIG. 6 illustrates photographic evidence of aft rows of darts catching and passing forward rows of darts due to drafting.
Figure 6:
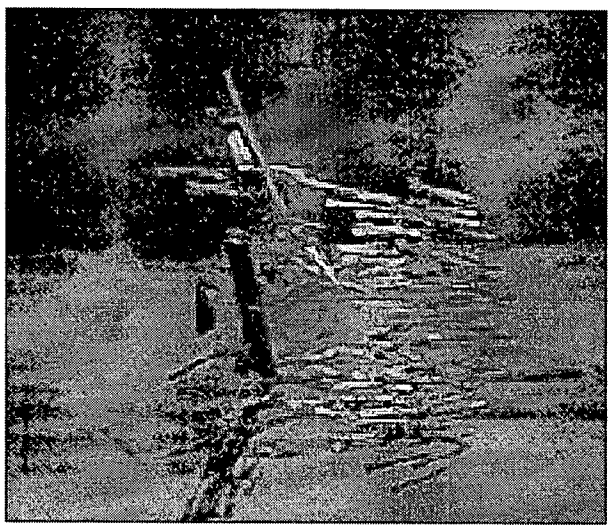
Figure 6:
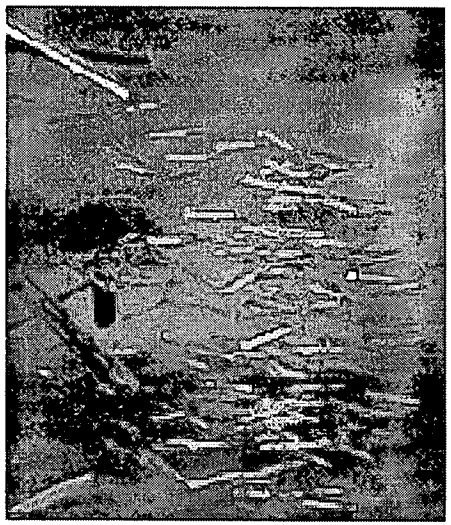

The typical goal for a projectile dispensing system is to achieve a predictable and uniform pattern at the target. (FIG. 1) The characteristics important to this pattern are that it must be of a predictable size and shape, that the projectiles within the pattern be uniform as opposed to randomly distributed, and that the pattern be free of voids, bunching, and flyers (projectiles way off target). It can be shown mathematically that an equilateral triangle pattern yields maximum uniformity. However, dispensers of the past have not been able to achieve this type of pattern for many reasons. The problems often exhibited by dispenser patterns from current technology are also shown. (FIG. 2) One of the reasons these sorts of problems occur is due to nose to tail packing. (FIG. 3) In a system like this, the projectiles are packed with every other projectile nose facing the opposite direction. The reason they are packed this way is to gain packing density, or how many projectiles per unit volume one can achieve. Even though a mild increase in density is achieved with nose to tail packing, the method does not allow the pattern at the target to be predictable and uniform. The reason for this is that half of the projectiles must turn 180 degrees to align themselves with the velocity vector. In the process of the projectiles rotating, many collisions occur knocking projectiles into unpredictable locations. Also, since the pattern is flying at high speed through air, typically the varying angles of attack, and therefore frontal areas, vary the amount of air drag force on the darts. This effect causes the darts to impact the target at different times, which also contributes to poor predictability and uniformness. General drafting trends in air are well known. (FIG. 4) For the case shown in the figure, x is the separation distance. The diameter is d. Notice while x/d is less than about 2.2, the drag coefficient, $C_d$, is actually negative for the trailing projectile. Then, as x/d continues to increase to about 7, the trailing projectile's $C_d$ is lower than that of the leading projectile. This means, for identical projectiles, the deceleration due to drag will be less for the trailing projectile, which in turn, means the trailing dart will catch the leading projectile given enough time. It is very important to note, however, that as x/d gets large enough, the $C_d$ of the trailing dart eventually asymptotically approaches that of the leading dart. These trends were verified with aerodynamic modeling of a dart type projectile. (FIG. 5) This idea of drafting is very important in creating a dispenser that is predictable and uniform. Most dispensers operate from a tube of some sort whether it is a missile, bomb, or some other type of weapon. Dispensing the projectiles out in rows is a common technique. However, dispensing out rows of projectiles allows the following projectiles to catch up to and even pass leading projectiles, causing collisions along the way. (FIG. 6) In the test results shown, one can clearly see that the second row of projectiles overcame the leading row.

Figure 7:
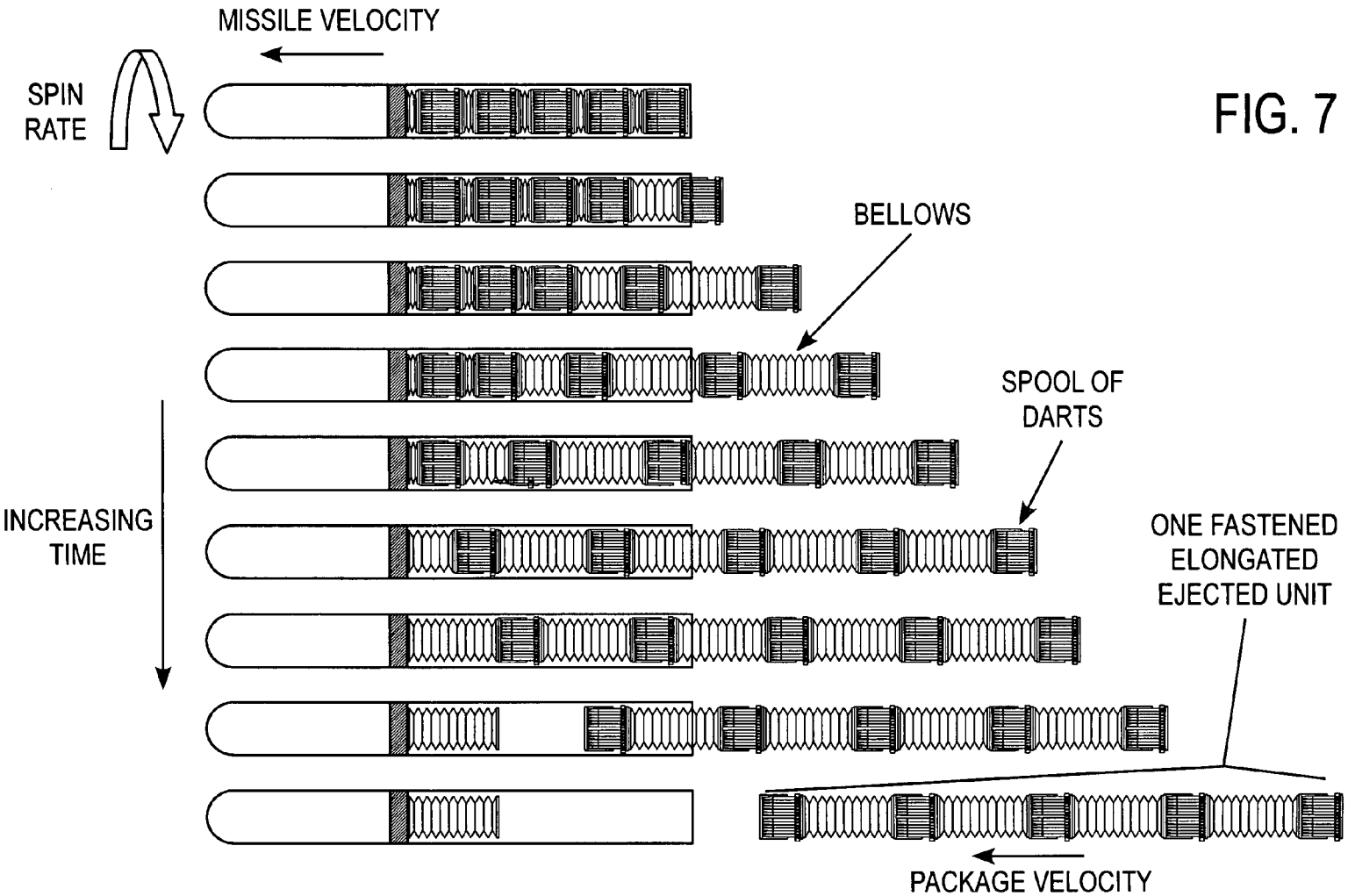
FIG. 7 illustrates the sequence of events that occurs while ejecting spools in an integrated fashion in, in accordance with the invention.

The bellows, spool, and collar dispenser solves or greatly improves each of the problem areas discussed above. The first issue is drafting. In a multi-row dispenser, the effects of drafting described above become very relevant. Since we know that the $C_d$ of the trailing projectile will be practically the same as the leading projectile if the separation distance between them is great enough, the dispenser must be capable of creating this appropriate gap before the projectiles are released. To achieve these separation gaps, the dispenser must operate with a carefully controlled sequence of events as opposed to one or two single events like typical dispensers use. The integrated base ejection method achieves the separation gap necessary to solve the drafting problem. (FIG. 7) In this example, the missile is flying with velocity to the left and is spinning about its longitudinal axis spun up by a solid rocket motor (Not shown). The rocket motor is cut away from the missile body exposing the dispenser section just before dispense is desired. In this system, projectiles are packaged into spools. Between each spool, is an energetic bellows actuator. The bellows can all be individually actuated to give a specific sequence of pushes to the spools. In this case, the spools are all fastened to the bellows (bellows remain rigid after expansion). The fifth or aft most spool is actuated first. A short delay later, the fourth spool is actuated and so on until finally the first or forwardmost spool is actuated. The result is a single elongated and fastened unit of spools ejected from the aft end of the missile. The elongated unit has the appropriate spacing between spools, or rows, of projectiles to overcome the drafting effects. The elongated ejected unit is still flying to the left just like the missile is; only the elongated unit is going slightly slower due to ejection. The ejection sequence is orchestrated by a state of the art electronic controller (not shown). The controller is flexible enough to be programmed to set the delays to whatever is necessary to achieve proper ejection of the elongated unit. The delays can be the same or can vary spool to spool. For even more flexibility, the amount of gunpowder in each actuator can be varied to achieve different ejection velocities, as can the number of convolutions and wall thickness of the bellows.

Figure 8:
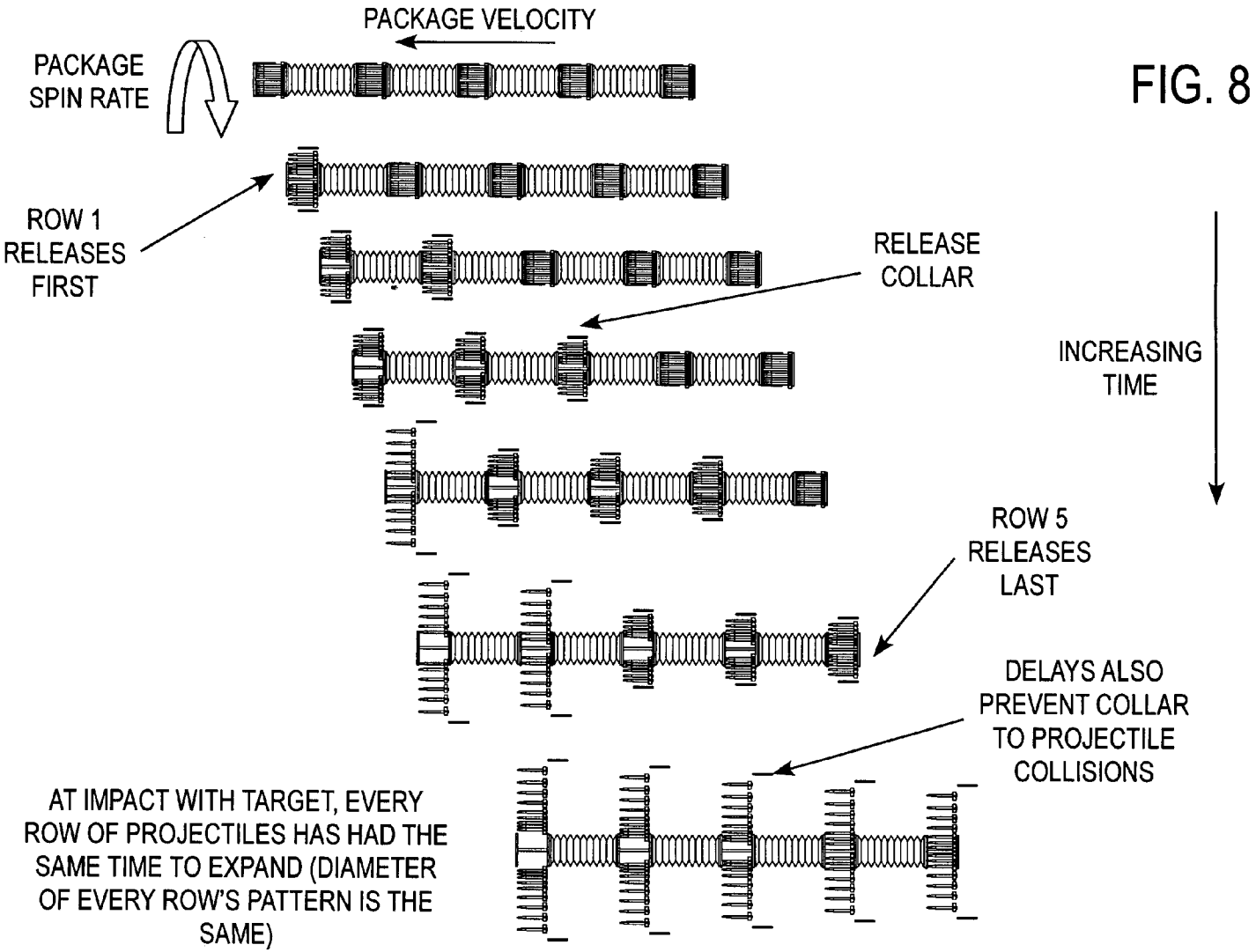
FIG. 8 illustrates the sequence of events that occurs while releasing projectiles from an ejected integrated package of spools.

Once the single, elongated and fastened unit has been ejected from the missile with enough space between spools to conquer drafting effects, the projectiles must be released. (FIG. 8) The projectiles must be released in a very controlled fashion in order to avoid the undesired variation of angles of attack as the darts are released that causes uniformity problems. It is also important in a multi-row dispenser to release each row of projectiles such that they all have the same amount of time to expand before hitting the target. If all rows were simultaneously released, the pattern would be dense in the center and sparse at the periphery due to different expansion times row to row. The way to solve all these problems is to release each row, in this case each spool, at a very specific time in the dispense sequence. Because the package has already been ejected, wires from the controller have already been severed. In the bellows, spool, and collar system, a special electronic device that rides on one of the collars in each spool takes care of this. It is charged by the controller before ejection and is given a timer count down time to execute. The device in the collar, called a firing module, then electronically lives long enough to count down to its specific time and then cuts a cable surrounding the spool of projectiles. With this device, one can orchestrate the precise release sequence shown in the figure. The correct release sequence generally is forward to aft with the delay being equal to the amount of time to travel the spool-to-spool separation gap at the flying velocity. However, the system described is flexible enough to allow the release delays to be whatever is appropriate to get the desired pattern. One could tailor make a pattern to be denser in the middle or denser on the periphery for example, if that were desired.

Figure 9:
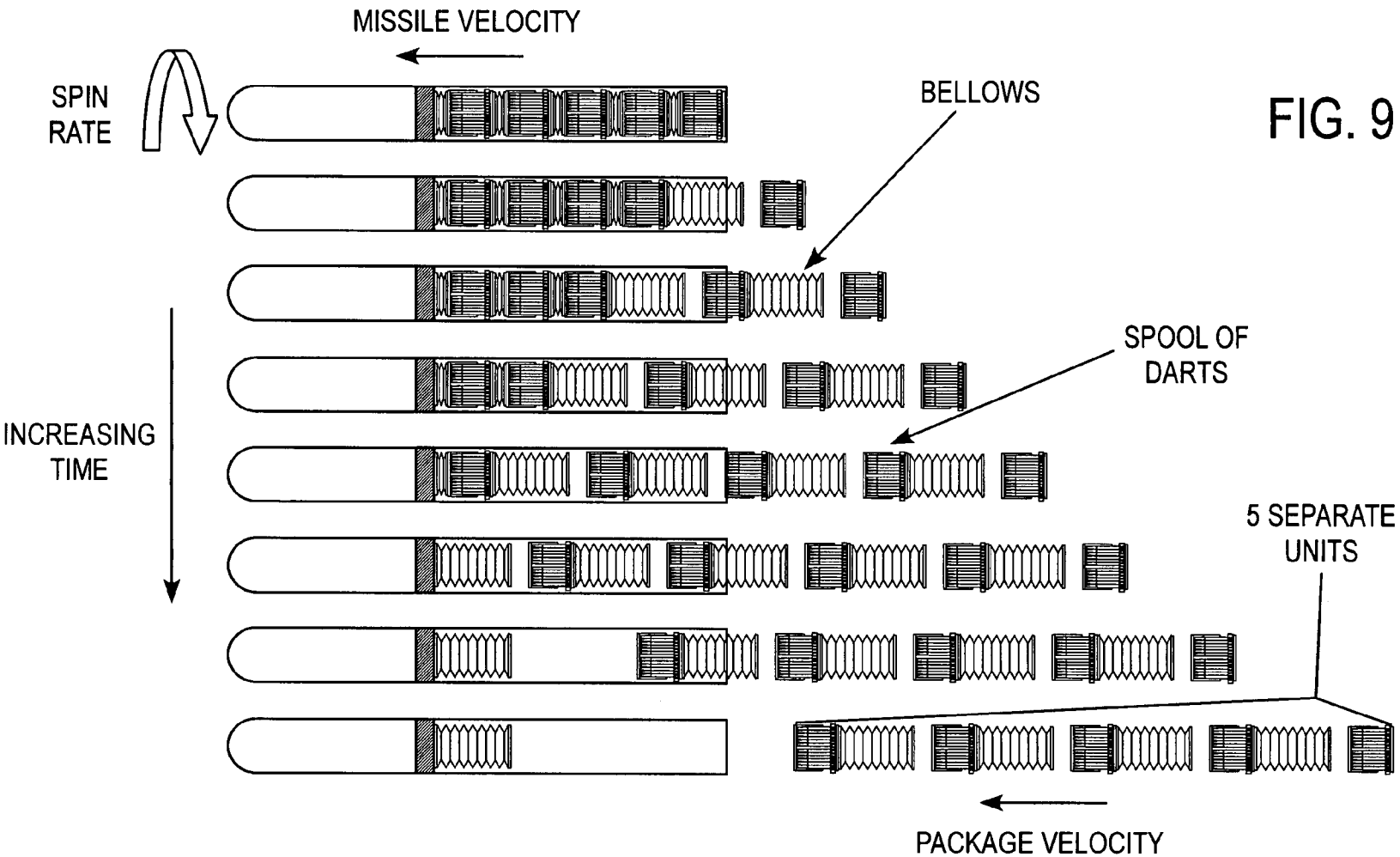
FIG. 9 illustrates the sequence of events that occurs while ejecting spools in a discreet fashion.
Figure 10:
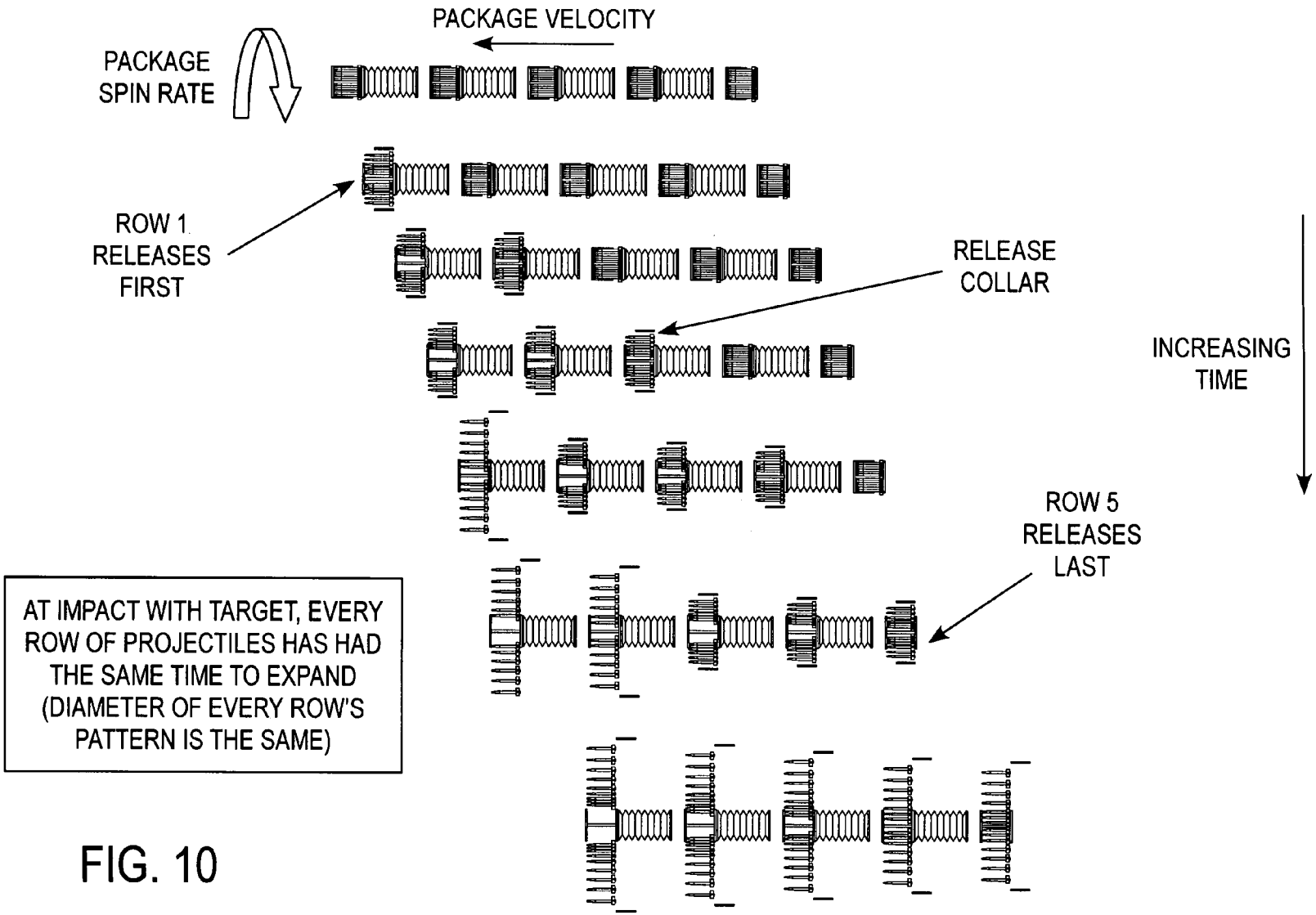
FIG. 10 illustrates the sequence of events that occurs while releasing projectiles from a separated group of discreet spool/bellows combination packages.

Another way of using the bellows, spool, and collar system to overcome drafting effects is the discreet approach. (FIG. 9) This approach is very similar in sequence to the integrated approach. The fundamental difference is that the forward flange of the spools is disconnected from the adjacent bellows. This creates five discreet spools or spool/bellows combinations. Choosing integrated verses discreet is a simple matter of how the system is mechanically assembled and is discussed in detail hereinafter. The discreet approach has advantages in certain situations. For example, the user may want to have two spools come out in unison and then be followed by three more sequentially or some other similar combination. Many possibilities for dispensing open up by this approach. The delay-cutting collar mentioned earlier still acts as the means to release the projectiles from the spinning spools in a very controlled manner. (FIG. 10) Again, there is much flexibility in when the projectiles can be released to achieve different goals and patterns.

Figure 11:
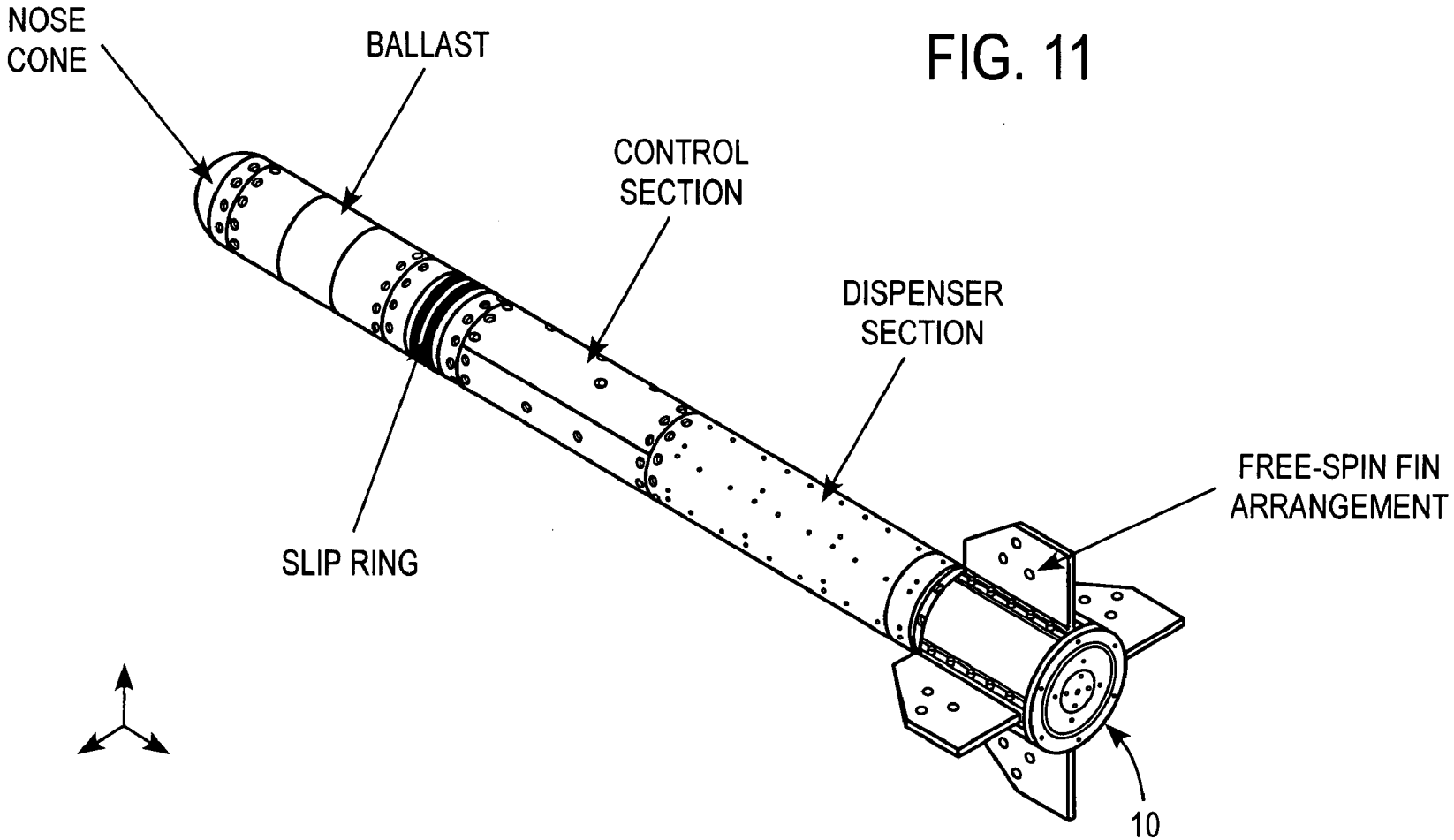
FIG. 11 illustrates a test device designed to test the various base ejection dispense methods.
Figure 12:
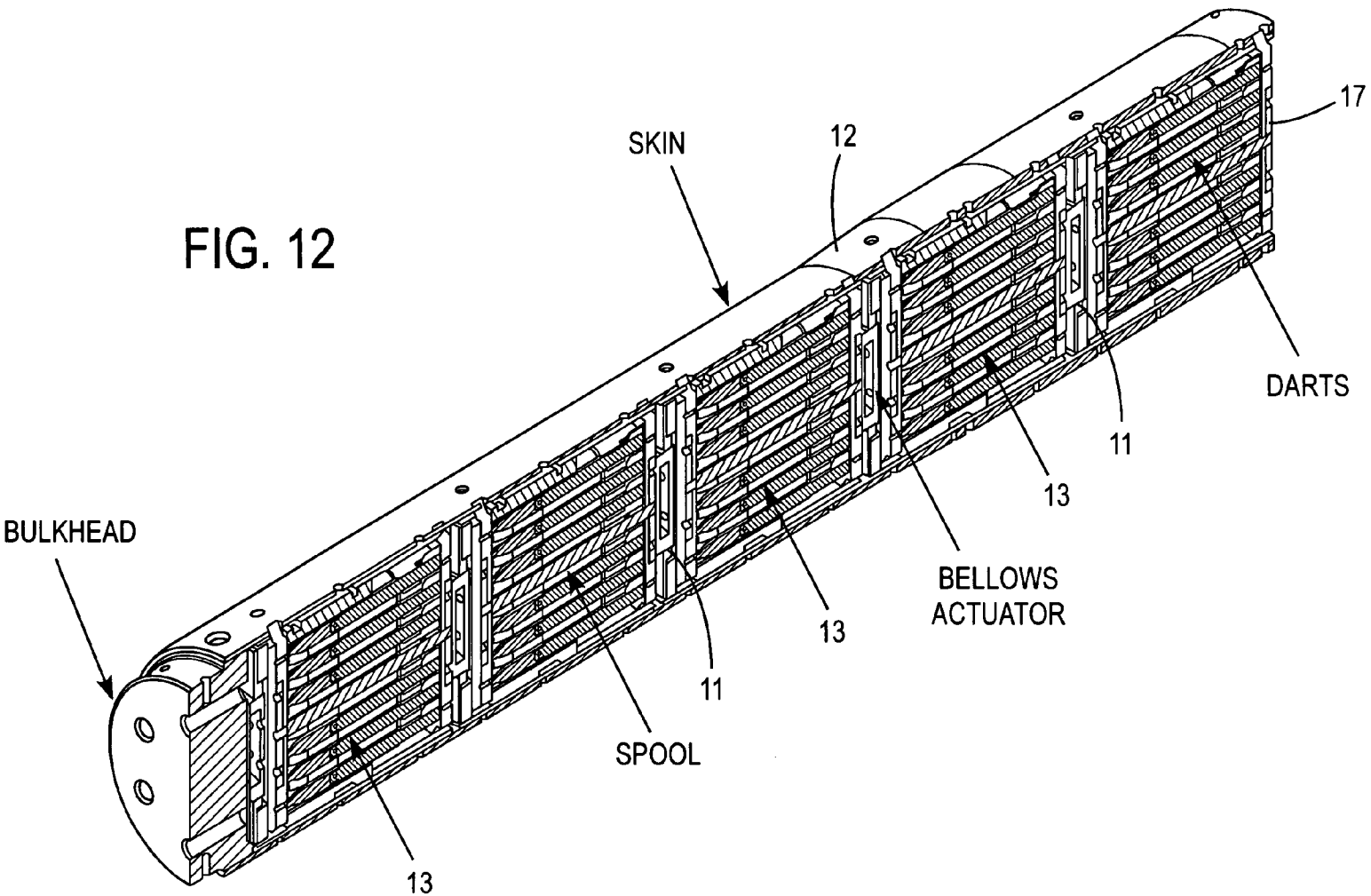
FIG. 12 illustrates the dispenser shown in FIG. 11 in section.
Figure 13:
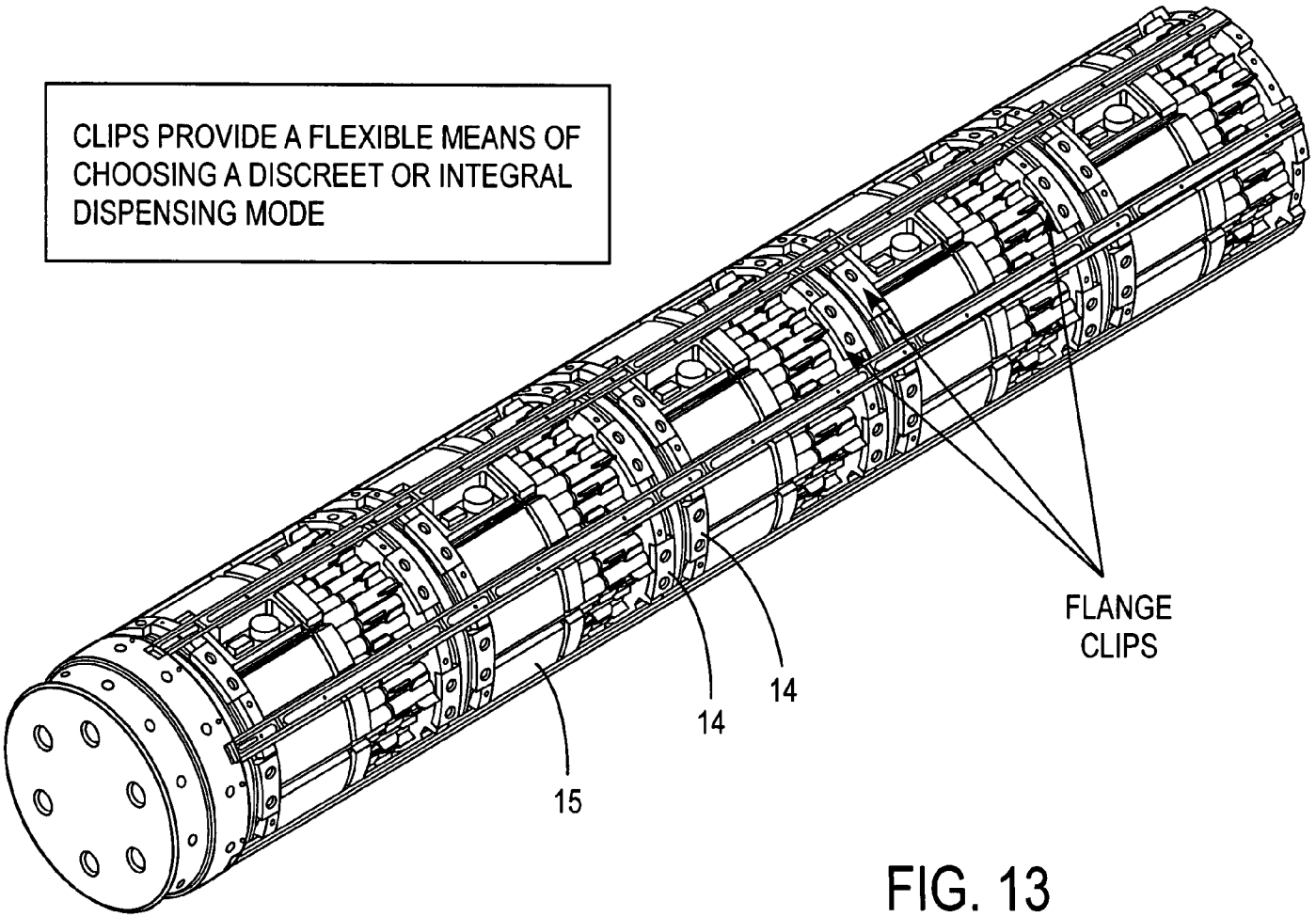
FIG. 13 illustrates the attachment method that allows the user to choose the integrated or discreet approach to ejecting the spools.
Figure 14:
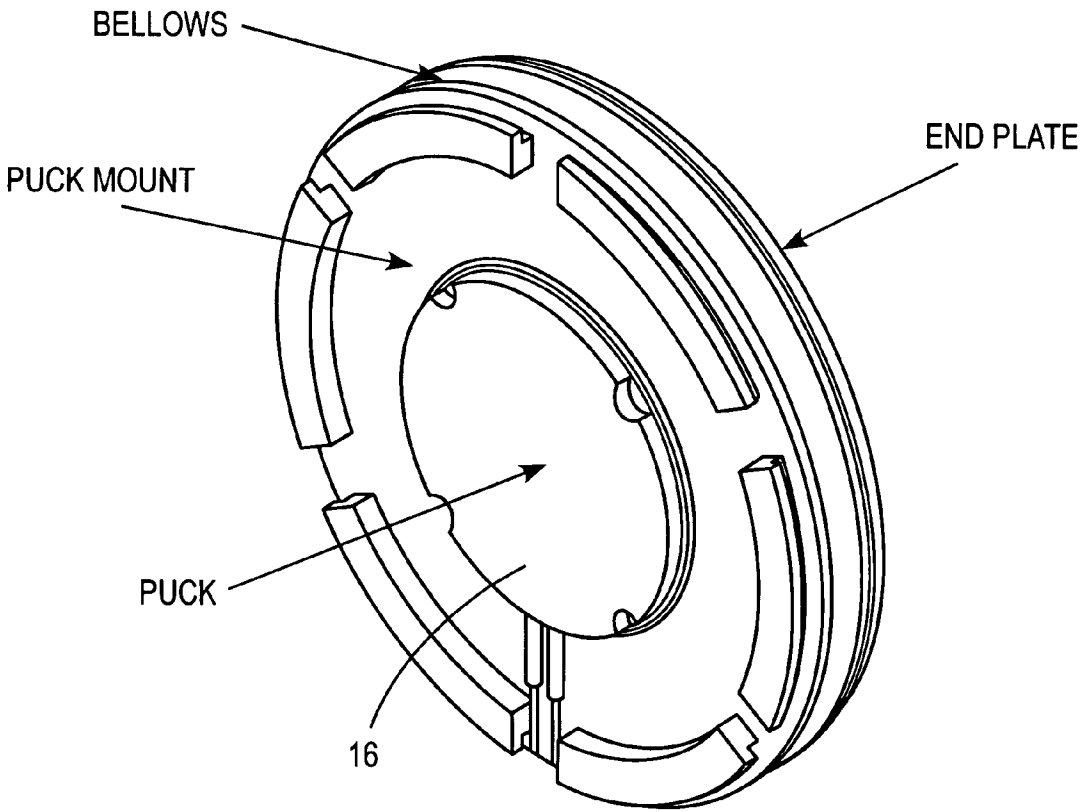
FIG. 14 illustrates the device that is used to push spools of projectiles at the desired time to the desired velocity.
Figure 15:
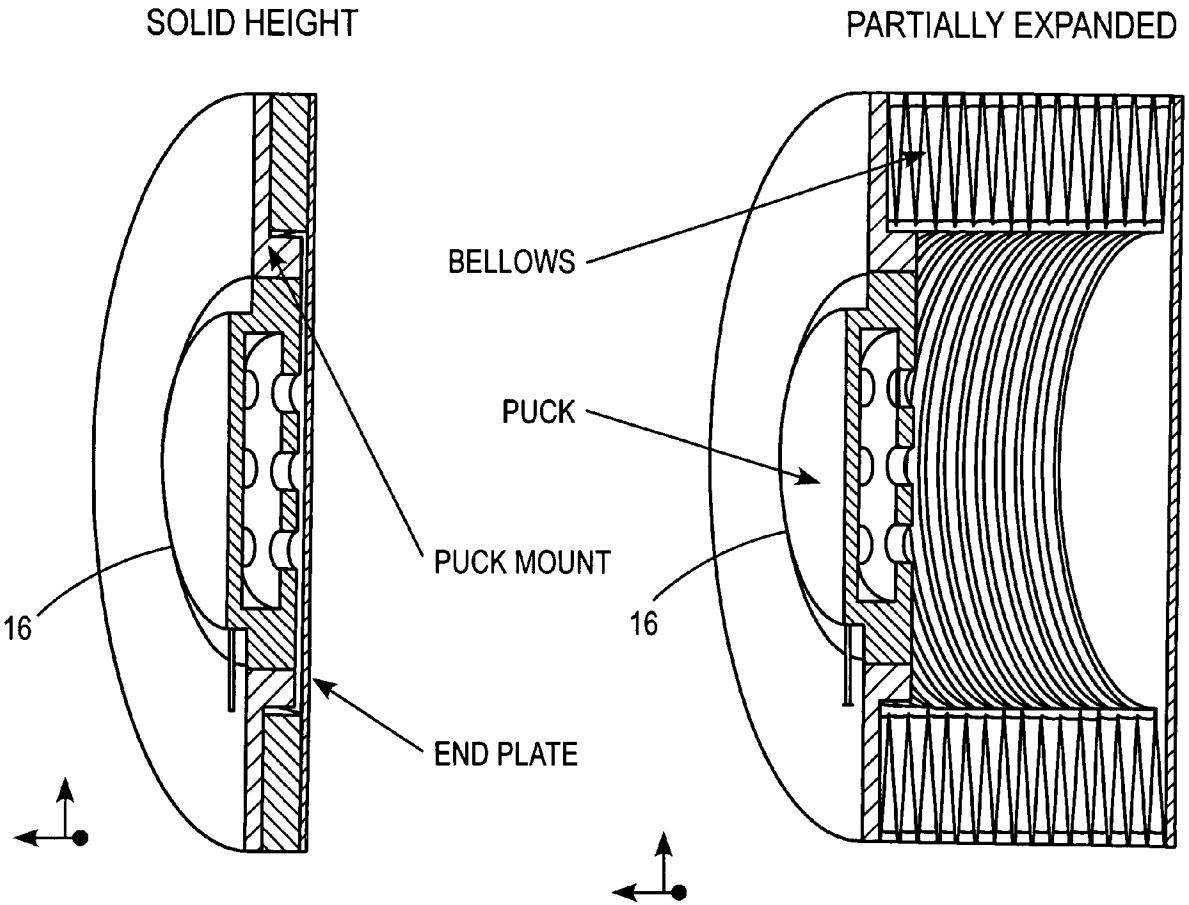
FIG. 15 illustrates the actuator in section view in both the compressed and partially expanded state.
Figure 16:
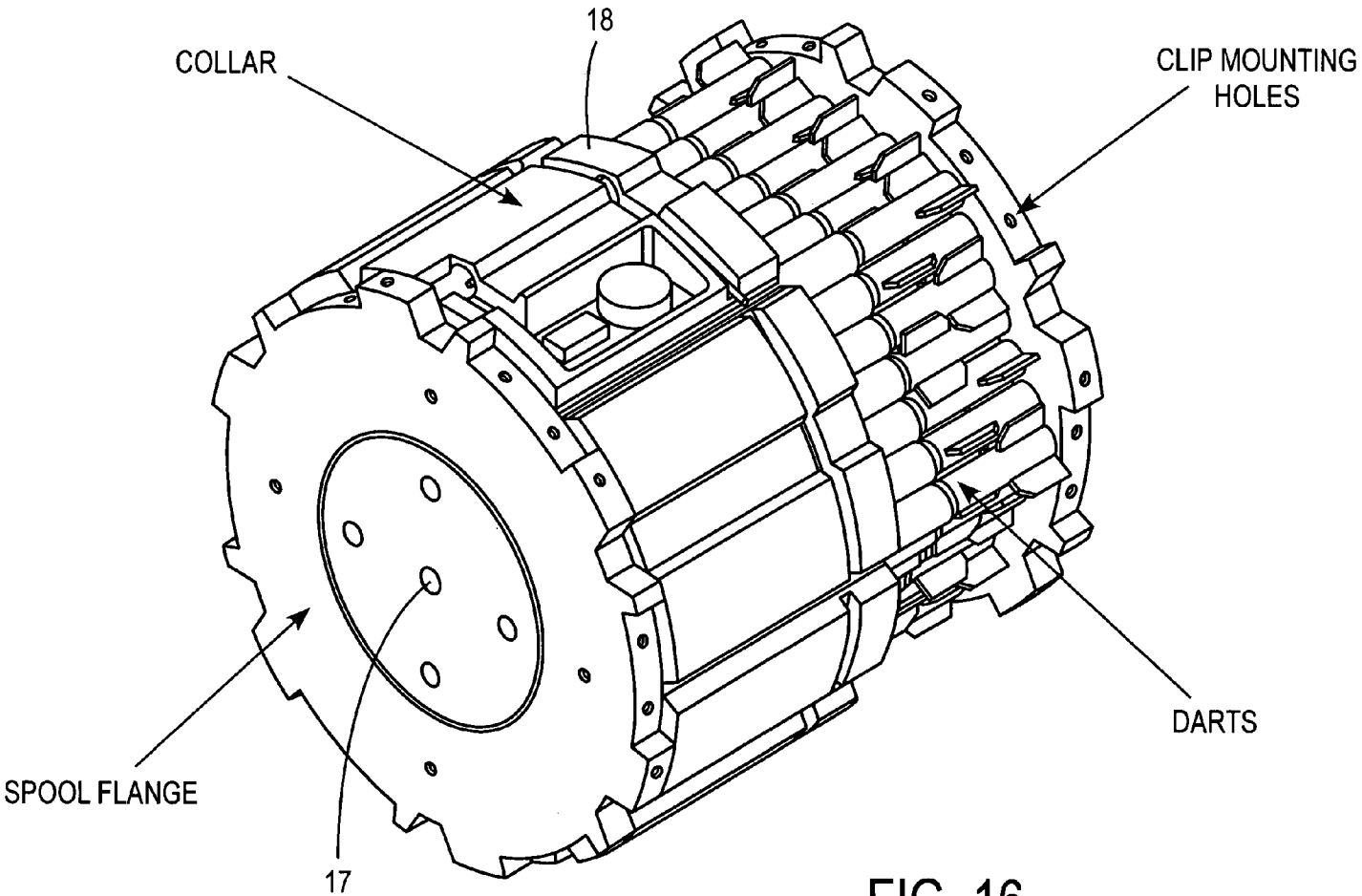
FIG. 16 illustrates a typical spool assembly including spool, darts, collars, and wire rope.
Figure 17:
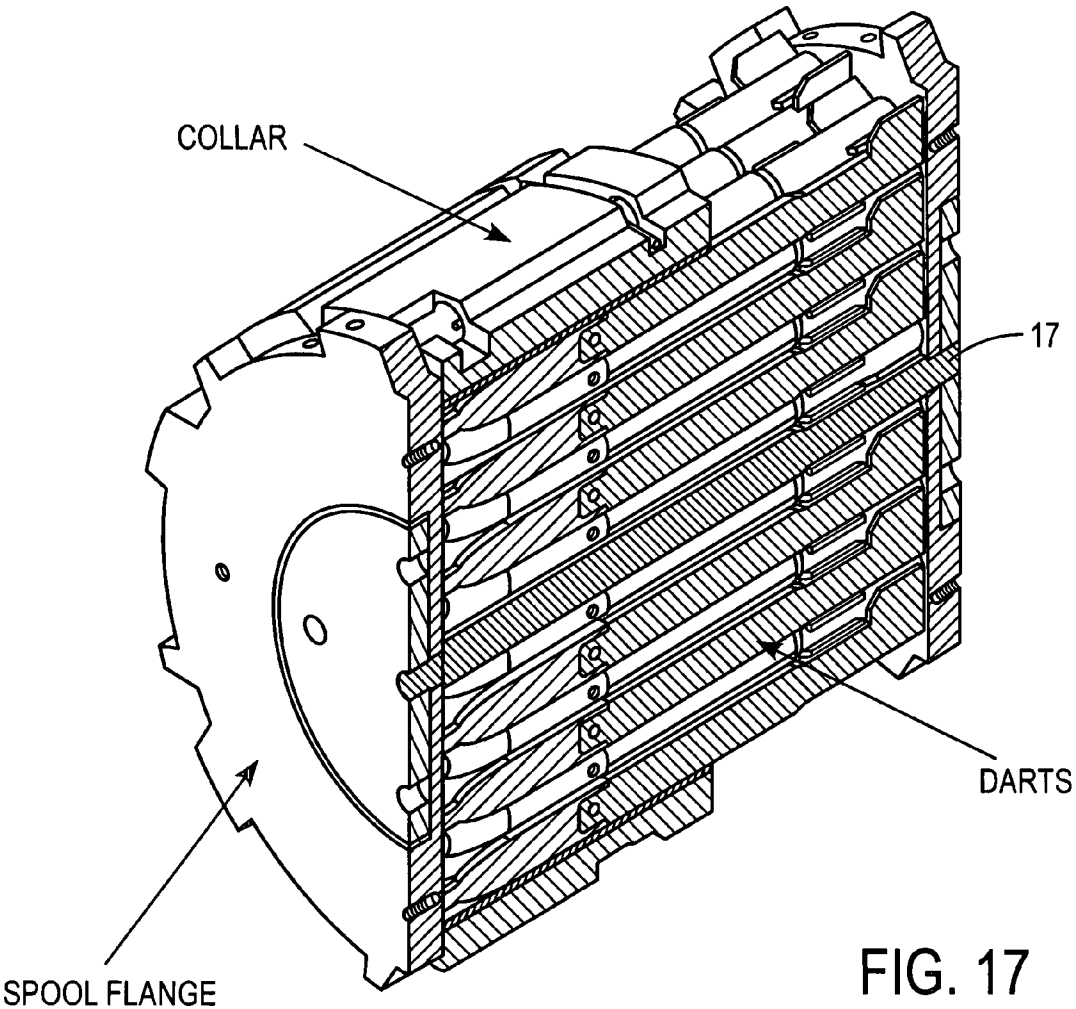
FIG. 17 illustrates the spool assembly in section, revealing the relationship between a center rod and the darts.

The dispenser sled test device 10 is one example of a weapon utilizing the bellows, spool, and collar system. (FIG. 11) This weapon will be used to take a closer look at each of the important elements that make the system work. The dispenser section inboard profile shows how the different elements would be packaged into a tubular weapon. Notice that there is an energetic bellows actuator 11 between each spool filled with projectiles. (FIG. 12) With the tubular skin 12 removed, one can see the spools 13 and the clip method of attaching the spool flanges to the lip flanges of the bellows end plates. In the integrated approach, all clips 14 would be utilized. In the discreet case, the clips on the forward end of the spool flange would not be used, allowing each spool/bellows combination to be an individual unit. The energetic bellows actuator is the root of the entire system. (FIG. 14) It is comprised of several bellows convolutions, an endplate, and a puck mount plate. The energetic puck 16 is a hollow disc filled with gunpowder propellant and a known electrically activated initiator. When the proper electric signal is received from the controller, the bellows expands rapidly. (FIG. 15) This sort of actuator works very well in the system because of its original pancake flat shape. The actuator (bellows) also contains all of the expansion gas from the gunpowder propellant. This enables the actual missile skin to be very thin since it does not take any pressure load. The energetic puck 16 can be filled with different amounts of propellant depending on the users particular needs. Changing the puck fill, allows the user to eject at higher or lower velocities. This flexibility is an important part of the system. The energetic bellows actuator pushes on and ejects the spool assembly. (FIG. 16) The projectiles are packed around the spool center rod 17 and then held firmly in place by a system of collars 18, in this case six. (FIG. 17) For other pattern periphery shapes, a different set of collars could be used. The collars 15 are wrapped with an aircraft cable or other similar cord 19.

Figure 18:
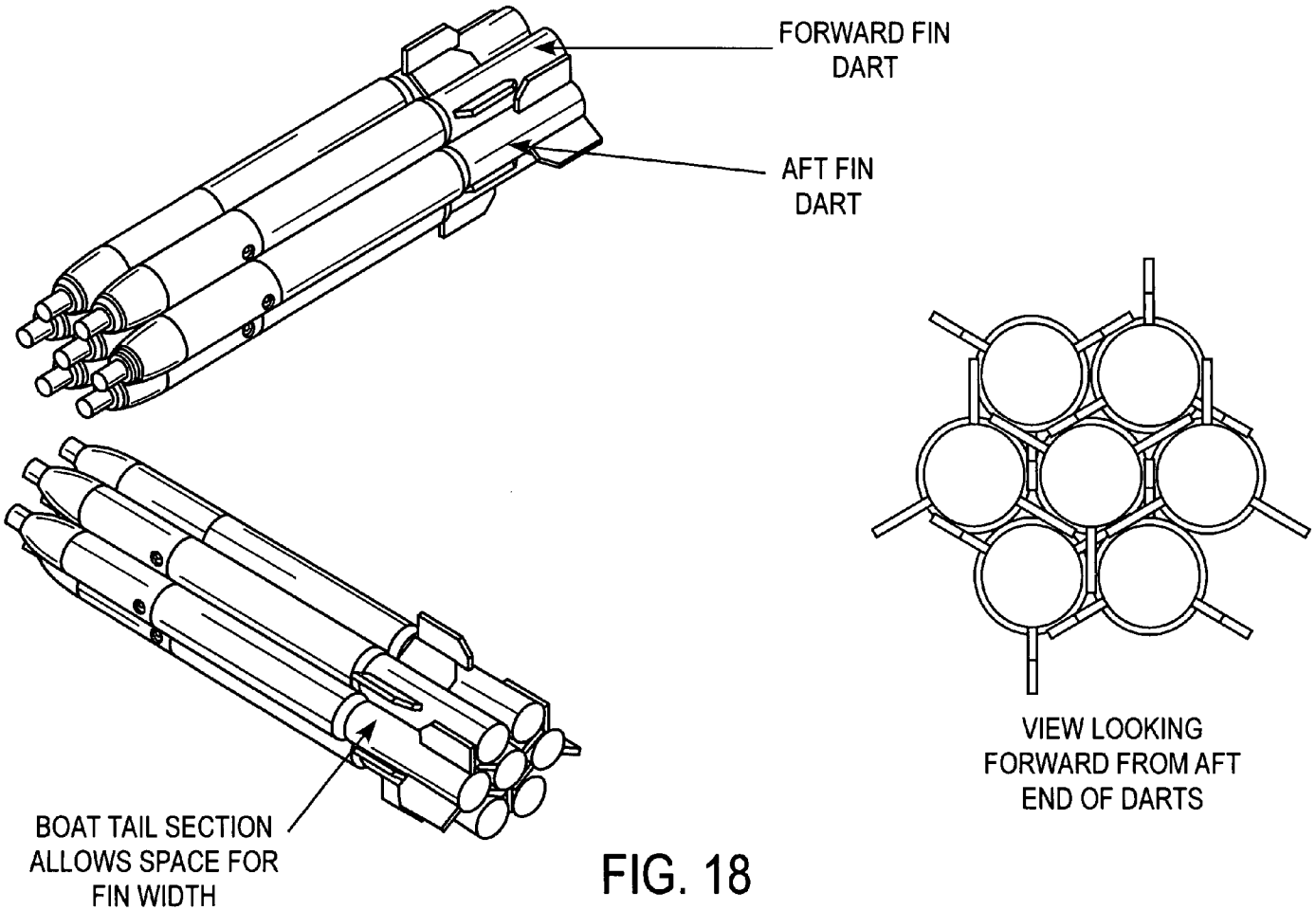
FIG. 18 illustrates the way to maximize packing density by incorporating a boattail aft section in the dart body and the use of forward and aft fin darts in alternate rows.
Figure 19:
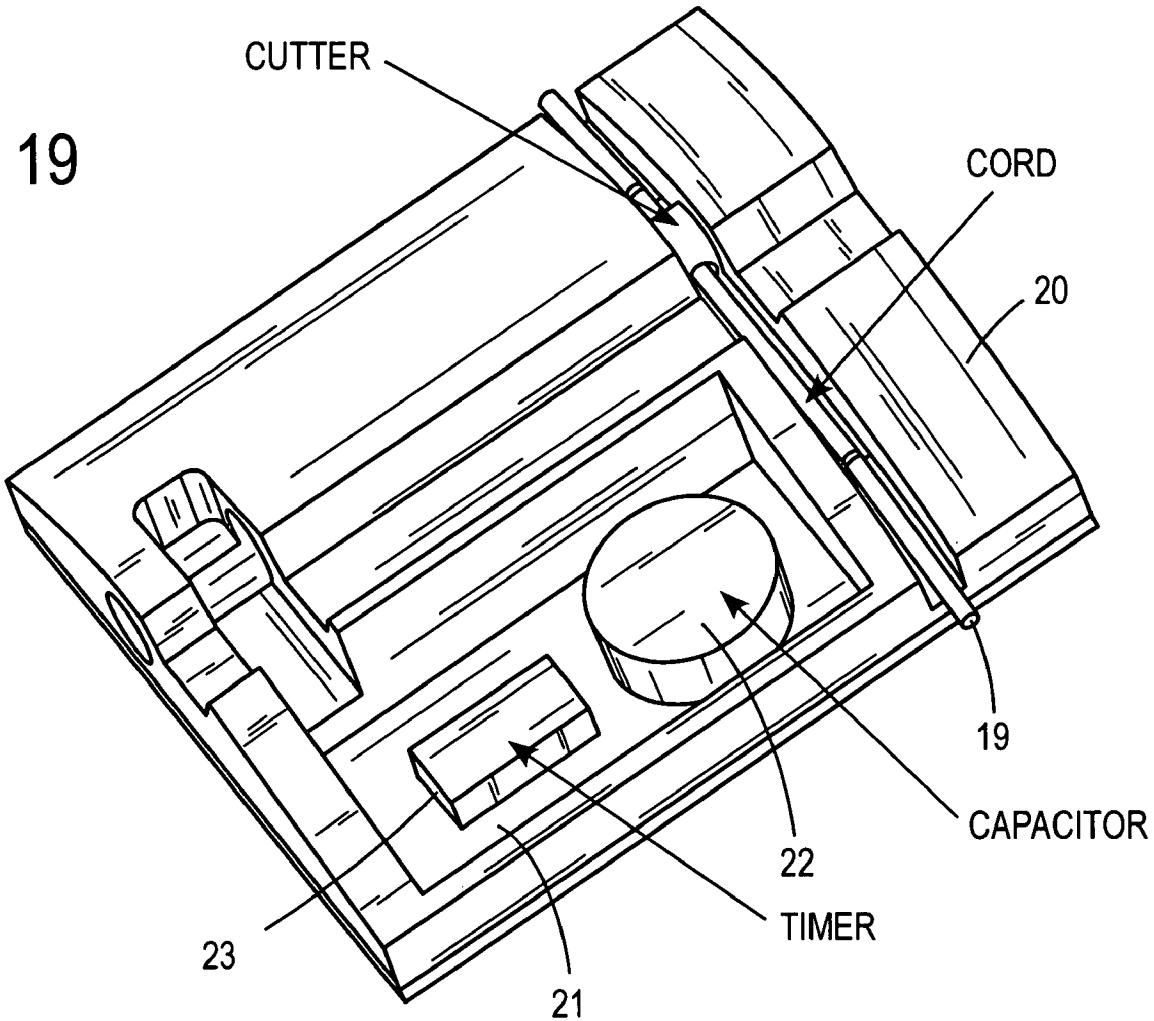
FIG. 19 illustrates a collar and its parts that are responsible for remaining active, even after all wires to the missile have been severed, and cutting the aircraft cable at a precise time during the dispense sequence.

One important improvement in projectile packing density is the addition of a boattail feature on the aft end of the projectile. (FIG. 18) Past dispensers have utilized the alternating forward fin and aft fin darts, but it is the slight reduction in diameter on the aft end of the projectile body, called a boattail, that allows the user to get true tangent projectile packing. The diameter reduction of the body to create the boattail is typically the width of the projectile fins but doesn't have to be to gain packing density The next important element of the bellows, spool, and collar system is the smart collar. (FIG. 19) This collar houses a small electronic board 21 on one side and an explosive wire cutter in the other. The electronic board has the means of storing electrical energy in the form of a capacitor 22. This capacitor continues to provide power to the board components even after the spool has been ejected from the missile and all of its wiring severed. A timer device on the board counts down to a preprogrammed time from the start of the spool ejection sequence. Once the timer counts down, the charged capacitor on the board discharges into the cable cutter. The cable cutter then proceeds to cut the cable and release the darts. The collar centers of gravity are farther away from the axis of spin than the outermost dart, so the collars travel faster away leaving the darts to expand in a controlled fashion without collisions or undesired angles of attack. It is this smart collar that allows for a dart release after the spools have been ejected. Because the release time is flexible, the release sequence is totally up to the user.

At this point in the disclosures, many of the problem areas in the prior art have been addressed. The bellows, spool, and collar system relieves drafting concerns by pulling the appropriate separation gap between spools before releasing the projectiles. Improved uniformity of pattern is obtained by releasing the darts in controlled sequence after full ejection, helping to control angle of attack problems at release. Improved uniformity is obtained by providing a programmable means of releasing the different projectile rows at different times. Packing density has been addressed by the improvement of adding a boattail to the projectiles. The size of the pattern at the target is controlled with the controllers precise timing of events, and finally, the periphery shape of the pattern is controlled with the system of collars put around the spools. There is one more important improvement in uniformity that needs to be discussed.

Figure 20:
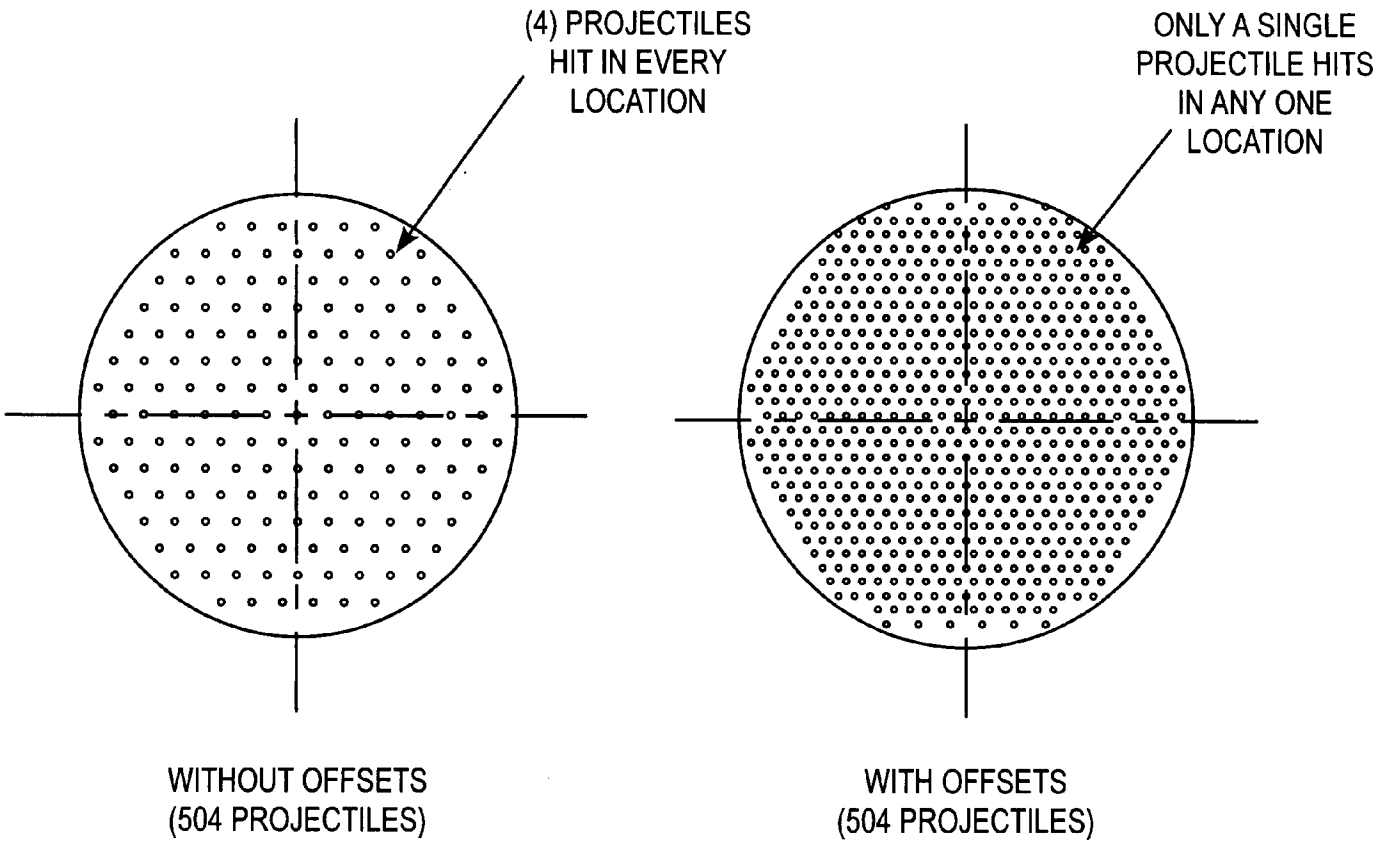
FIG. 20 illustrates the pattern at the target with and without the use of offsets between rows of projectiles.
Figure 21:
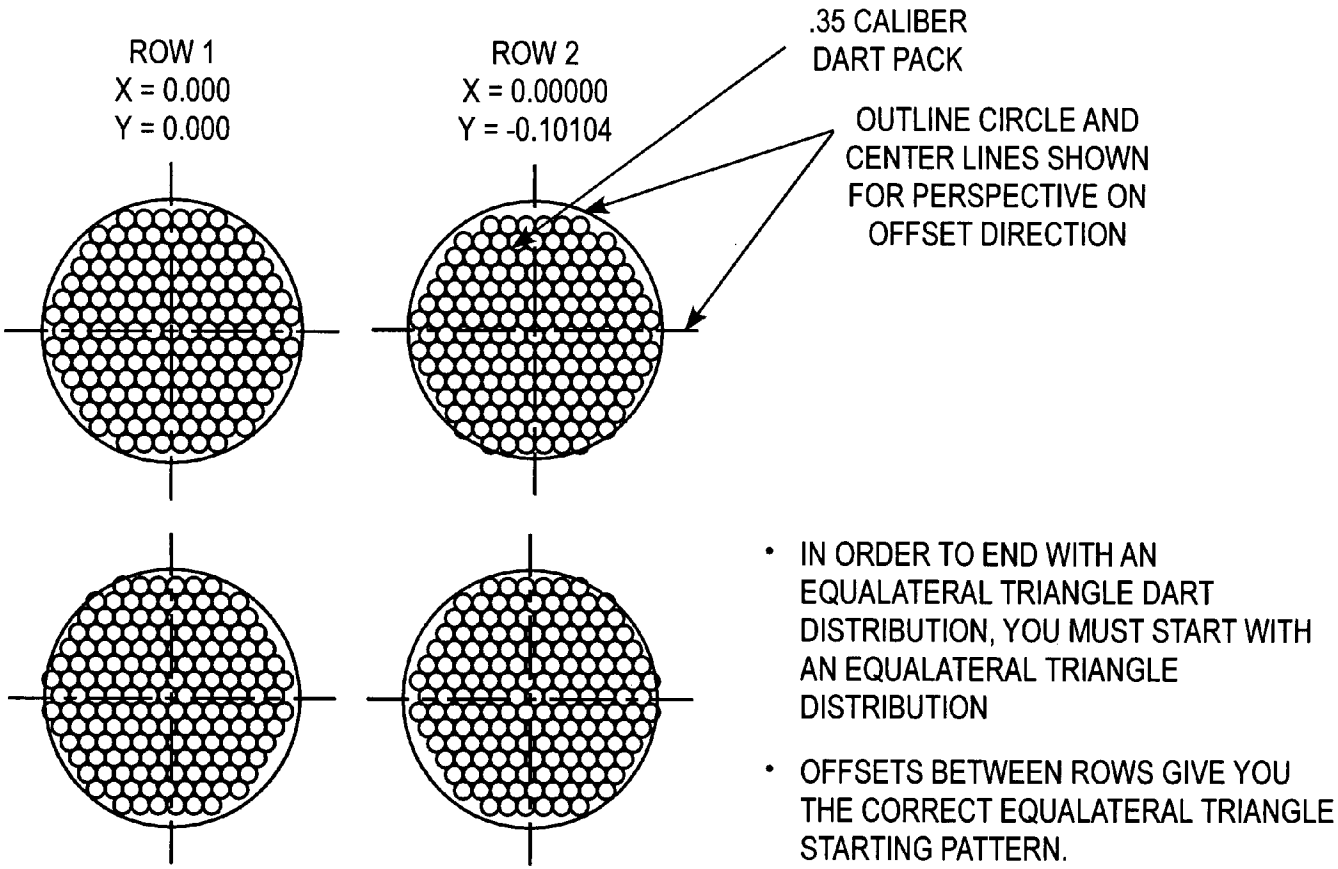
FIG. 21 illustrates how to achieve a uniform pattern at the target by creating a uniform pattern with row offsets in the original packing arrangement.

In a multi-row dispenser that utilizes spin as its expansion motivation, the pattern for a specific row on the target is merely an expanded version of the pattern in the row as it is packed in the missile body or tube. In other words, if the periphery shape is a square in the packing, it will be a square at the target. What is even more important is that the relationship projectile to projectile within the row will also stay the same, but just in an expanded state at the target. For this reason, if one had four rows of projectiles packed exactly the same, and one simultaneously released all four rows, there would be four darts hitting every location on the target and the pattern would appear to have one fourth of the projectile holes as projectiles in the system. (FIG. 20) The pattern on the left represents four rows all packed exactly the same and released simultaneously. The pattern on the right, however, is the actual desired pattern. To achieve this desired pattern, offsets in the collar system must be provided for. (FIG. 21) By offsetting each of the four rows slightly, one can create a system of rows of projectiles where no single projectile is in line with any other projectile in the entire system. In fact, one can create the equilateral triangle pattern needed for true uniformity in the packed rows. This will result in expanded uniformity at the target. Specifically, in the bellows, spool, and collar system, the offsets would be achieved by each of the six collars being slightly different in radial height between dart pattern and missile skin.

Figure 22:
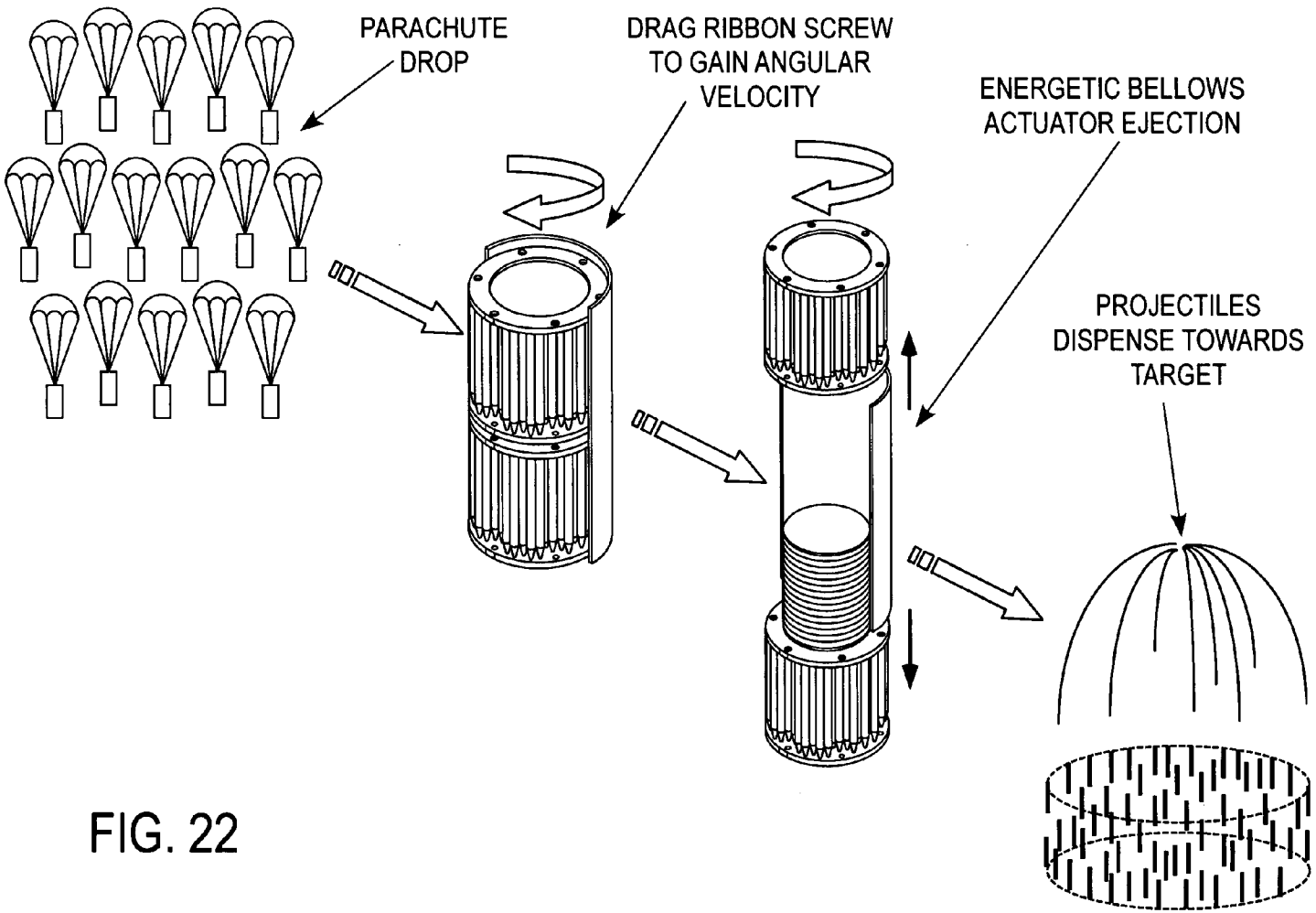
FIG. 22 illustrates one of many possibilities of using the disclosed system in submunition dispensing.
Figure 23:
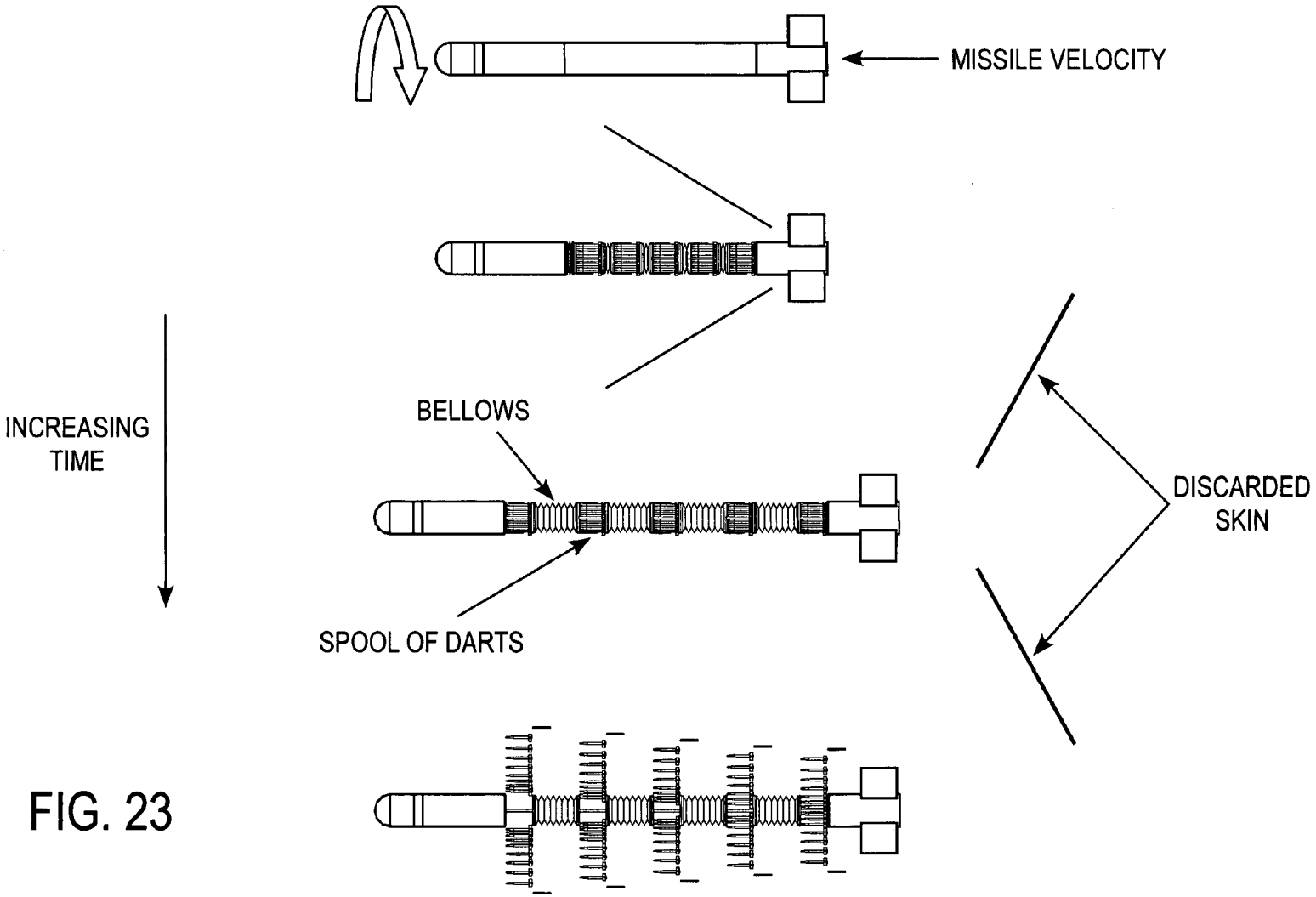
FIG. 23 illustrates one of many applications of using the disclosed system to dispense projectiles from a missile.

The application of the bellows, spool, and collar dispensing system is not limited to the specific case used in the above-described system. One alternative use is in dispensing sub munitions (FIG. 22). In this case, a plurality of 2-spool, 1-bellows cans is dropped via parachute. After cutting away from the parachute and getting angular velocity from a screw drag ribbon, the two spools are pushed away from one another and released via the collar cable cutting system to dispense the projectiles on the ground. Another application would be to use the system to dispense projectiles from an elongated missile without a shell (FIG. 23). In this case, the missile dispenser sections would be forced to elongate via bellows actuation. The darts could then be released row by row from the missile with the collar cable cutting system.

I wish it to be understood that I do not consider the invention to be limited to the precise details disclosed in the specification, for obvious modifications will occur to those skilled in the art to which the invention pertains.

I claim:

1. In an airborne projectile dispenser, the improvement comprising:

at least one spool for supporting a plurality of projectiles in substantially parallel relation, a collar retaining said projectiles within said at least one spool, means for opening said collar to release said projectiles, said means for opening including means for timing the period of release of said collar to release said projectiles from said at least one spool in specific sequence following separation from said dispenser, and plural spools and collars arranged in coaxial alignment, said collars being of variable radial diameter relative to each other, so that when said spools are arranged within said dispenser, individual projectiles within spools are laterally offset with respect to corresponding projectiles in other spools to obtain a uniform projectile distribution pattern when meeting a target.

2. The improvement set forth in claim 1, including a cable surrounding said collar, and timed means for cutting said cable to release said collar from around said spool.

3. The improvement set forth in claim 2, in which said means for cutting said cable includes a capacitively powered circuit board.

4. A projectile dispenser system comprising:

an airborne projectile dispenser having a principal axis;

a plurality of projectile-carrying spools carried by said airborne dispenser in axial alignment with said principal axis for serial discharge therefrom, said spools carrying plural projectiles in mutually parallel relation for radially-directed discharge from said spools;

means for maintaining said projectiles within said spools prior to discharge;

means for holding said means for maintaining in fixed position;

means for releasing said means for maintaining;

timing means for initiating operation of said means for releasing;

expandable bellows interconnected to said spools at one end thereof;

means for selectively inflating said bellows at timed intervals for serially-ejecting said spools from said airborne dispenser; wherein said spools are positioned in mutually-axially aligned locations prior to discharge of projectiles from said spools.

5. A projectile dispenser system in accordance with claim 4, said expandable bellows being expanded by electrically ignited gunpowder of predetermined quantity, thereby determining the degree of mutual spacing of said spools.

6. A projectile dispenser system in accordance with claim 4, in which at least some of said spools comprise means for interconnection with an adjacent spool, wherein at least a pair of spools are maintained in abutted relation after discharge from dispenser.

7. A projectile dispenser system in accordance with claim 4, in which the discharge of projectiles from each spool is timed such that each of the plural projectiles in mutually parallel relation has the same amount of time to expand before reaching a target.

8. A projectile dispenser system in accordance with claim 4, wherein said means for maintaining said projectiles within said spools prior to discharge is a collar.

9. A projectile dispenser system in accordance with claim 4, wherein said means for holding said means for maintaining in fixed position is a cable.

10. A projectile dispenser system in accordance with claim 9, wherein said means for releasing is a cable cutter.

11. A system for dispensing projectiles from a munition, the system comprising:

a plurality of spools, each spool arranged in sequential relationship along a linear axis and each spool including a plurality of projectiles;

a bellows connected between at least two of the plurality of spools, the bellows expandable along the linear axis from a collapsed compacted state to an elongated extended state; and at least one controller to initiate ejection of the plurality of projectiles from the plurality of spools, wherein the controller initiates ejection of the plurality of projectiles on sequential spools in time-related manner such that initiation of each sequential spool is at an essentially common point in space.

12. The system of claim 11, wherein the plurality of projectiles on at least one of the plurality of spools are all positioned with a head of each projectile arranged in a common orientation.

13. The system of claim 12, wherein an aft stabilizing fin on a first group of the plurality of projectiles is offset from an aft end of each of the projectiles of the first group a first distance and an aft stabilizing fin on a second group of the plurality of projectiles is offset from an aft end of each of the projectiles of the second group a second distance, the first distance different from the second distance and wherein a diameter of an aft portion of each of the projectiles is reduced by an amount approximating a thickness of the aft stabilizing fin.

14. The system of claim 13, wherein the first distance is at least one stabilizing fin length different than the second distance.

15. The system of claim 11, wherein the plurality of projectiles is mounted on at least one of the plurality of spools with at least one collar, the at least one collar having a flat inner surface adjacent at least an outer group of the plurality of projectiles and a curved outer surface.

16. The system of claim 15, wherein a thickness of the collar on each subsequent spool of the plurality of spools has a different thickness.

17. The system of claim 15, wherein the inner surface of a first collar on a first spool is mounted offset from a center axis of the first spool a different distance from the inner surface of a second collar on a subsequent spool, and the curved outer surface of the first collar and the curved outer surface of the second collar are at a same radial distance from an axial centerline of the munition.

18. The system of claim 15, wherein the collar includes a plurality of portions and an aggregate of each of the inner surfaces forms a geometric shape.

19. The system of claim 18, wherein the geometric shape is one of a hexagon and an octagon.

20. The system of claim 11, wherein the bellows are releasably connected to two sequential spools.

21. The system of claim 11, wherein in the elongated extended state of the bellows, sequential spools are connected by the bellows.

22. The system of claim 21, wherein sequential spools are separated by a distance related to a forward traveling velocity of the plurality of spools such that every row of projectiles expands to a similar pattern and size.

23. The system of claim 11, wherein a length of the elongated extended bellows is a distance effective to produce a separation distance between released projectiles of sequential spools to minimize interference drag.

24. The system of claim 23, wherein the separation distance is at least 5 inches.

25. The system of claim 11, wherein in the elongated extended state of the bellows, sequential spools are separated from the bellows and from each other.

26. The system of claim 11, comprising an ejection system to release the plurality of spools and bellows from the munition.

27. The system of claim 11, comprising means to remove an outer portion of the munition to expose the plurality of spools and the bellows.

28. A method of dispensing projectiles from a munition, the munition having a forward end and an aft end along a linear axis and including a system having a plurality of spools, each spool arranged in sequential relationship along the linear axis and each spool including a plurality of projectiles, and a bellows connected between at least two of the plurality of spools, the bellows expandable along the linear axis from a collapsed compacted state to an elongated extended state, the method comprising:

expanding successive bellows in a sequence from an aft end bellows to a forward end bellows;

releasing the plurality of projectiles from a first spool to form a first shape at a first point in a travel path of the plurality of projectiles from the first spool releasing the plurality of projectiles from a second spool in a timed relationship relative to releasing the plurality of projectiles from the first spool to form a second shape, wherein the plurality of projectiles from the second spool generally travel along the travel path of the plurality of projectiles from the first spool and the second shape is substantially similar to the first shape at the first point in the travel path.

* * * * *